US009380670B2

(12) United States Patent
Zhang et al.

(10) Patent No.: US 9,380,670 B2
(45) Date of Patent: Jun. 28, 2016

(54) GENERATING A VOLTAGE FEEDBACK SIGNAL IN NON-ISOLATED LED DRIVERS

(71) Applicant: Dialog Semiconductor Inc., Campbell, CA (US)

(72) Inventors: Chenglong Zhang, San Jose, CA (US); John William Kesterson, Seaside, CA (US); Chin Li, Campbell, CA (US); Ping Lo, Santa Clara, CA (US); Chuanyang Wang, San Jose, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 0 days.

(21) Appl. No.: 14/486,878

(22) Filed: Sep. 15, 2014

(65) Prior Publication Data

US 2016/0081152 A1 Mar. 17, 2016

(51) Int. Cl.
*H05B 33/08* (2006.01)

(52) U.S. Cl.
CPC ..... *H05B 33/0845* (2013.01); *H05B 33/089* (2013.01)

(58) Field of Classification Search
CPC ..... H05B 33/0845; H05B 33/089; H05B 33/0809; H05B 37/02; H05B 33/0815; H05B 33/0848; H02M 3/33523
USPC ..... 315/85, 307, 200, 224, 294, 290
See application file for complete search history.

(56) References Cited

U.S. PATENT DOCUMENTS

| | | | | |
|---|---|---|---|---|
| 9,084,303 | B2 * | 7/2015 | Wee et al. | |
| 2012/0286663 | A1 * | 11/2012 | Puvanakijjakorn et al. | 315/85 |
| 2014/0327372 | A1 * | 11/2014 | Zhang et al. | 315/224 |
| 2015/0002036 | A1 * | 1/2015 | Sun et al. | 315/200 R |

FOREIGN PATENT DOCUMENTS

DE 198 14 681 A1 10/1999

OTHER PUBLICATIONS

Rashid, Muhammad H.. (2011). Power Electronics Handbook—Devices, Circuits, and Applications (3rd Edition). Elsevier. Online version available at: http://app.knovel.com/hotlink/toc/id:kpPEHDCAE1/power-electronics-handbook/power-electronics-handbook.*

Texas Instruments (2013). LM3445 Triac Dimmable Offline LED Driver. Online version available at: http://www.ti.com/lit/ds/symlink/lm3445.pdf.*

German Office Action, German Application No. 102015215659.1, Mar. 23, 2016, 12 pages.

* cited by examiner

*Primary Examiner* — Alexander H Taningco
*Assistant Examiner* — Renan Luque
(74) *Attorney, Agent, or Firm* — Fenwick & West LLP

(57) ABSTRACT

An LED lamp comprises one or more LEDs, an inductive element coupled to an input voltage source and the one or more LEDs, and a switch coupled to the inductive element. A first current detector is coupled between the input voltage source and a ground node of the LED lamp, such that a current detected by the first current detector is proportional to a bulk voltage across the input voltage source. A second current detector is coupled between the inductive element and the ground node, such that current detected by the second current detector is proportional to a drain voltage across the switch. A switch controller controls the switch based on a feedback signal indicative of a voltage across the inductive element, which is generated based on a difference between the current detected by the second current detector and the current detected by the first current detector.

19 Claims, 5 Drawing Sheets

GENERATING A VOLTAGE FEEDBACK SIGNAL IN NON-ISOLATED LED DRIVERS

BACKGROUND OF THE DISCLOSURE

1. Field of the Invention

This disclosure relates to driving LED (Light-Emitting Diode) lamps and, more specifically, to generating a feedback signal indicating voltage across the inductor of the LED lamp.

2. Description of the Related Art

LEDs are being adopted in a wide variety of electronics applications, such as architectural lighting, automotive head and tail lights, backlights for liquid crystal display devices, and flashlights. Compared to conventional lighting sources such as incandescent lamps and fluorescent lamps, LEDs have significant advantages, including high efficiency, good directionality, color stability, high reliability, long life time, small size, and environmental safety.

The use of LEDs in lighting applications is expected to expand, as they provide significant advantages over incandescent lamps (light bulbs) in power efficiency (lumens per watt) and spectral quality. Furthermore, LED lamps represent lower environmental impact compared to fluorescent lighting systems (fluorescent ballast combined with fluorescent lamp) that may cause mercury contamination as a result of fluorescent lamp disposal.

However, conventional LED lamps cannot be direct replacements of incandescent lamps and dimmable fluorescent systems without modifications to current wiring and component infrastructure that have been built around incandescent light bulbs. This is because conventional incandescent lamps are voltage driven devices while LEDs are current driven devices, thus requiring different techniques for controlling the intensity of their respective light outputs.

Many dimmer switches adjust the RMS voltage value of the lamp input voltage by controlling the phase angle of the AC-input power that is applied to the incandescent lamp to dim the incandescent lamp. Controlling the phase angle is an effective and simple way to adjust the RMS-voltage supplied to the incandescent bulb and provide dimming capabilities. However, conventional dimmer switches that control the phase angle of the input voltage are not compatible with conventional LED lamps, since LEDs, and thus LED lamps, are current-driven devices.

One solution to this compatibility problem uses an LED driver that senses the lamp input voltage to determine the operating duty cycle of the dimmer switch and reduces the regulated forward current through an LED lamp as the operating duty cycle of the dimmer switch is lowered. In some cases, the LED driver delivers power to the LED lamp across a transformer, isolating the output of the LED lamp from the input. To regulate the current through the LED, the LED driver receives feedback about an output voltage or current through the LED. Many LED drivers sense the output using an auxiliary winding on the primary side of the transformer. However, sensing the output voltage via an auxiliary winding adds complexity to the LED driver, increasing both the cost and the size of the LED driver.

SUMMARY

To reduce cost and complexity of an LED lamp, a feedback signal indicating voltage across an output of the inductor is generated without relying on an auxiliary transformer winding. An LED lamp according to various embodiments includes one or more LEDs and an inductive element (e.g., an inductor or a primary winding of a transformer) coupled to an input voltage source and the one or more LEDs. A switch is coupled to the inductive element such that current is generated in the inductor responsive to the switch being turned on and not generated responsive to the switch being turned off. A first current detector is coupled between the input voltage source and a ground node of the LED lamp, and a second current detector is coupled between the inductive element and the ground node. Current detected by the first current detector is proportional to a bulk voltage across the input voltage source, while current detected by the second current detector is proportional to a drain voltage across the switch.

In one embodiment, a comparator determines a difference between the current detected by the second current detector and the current detected by the first current detector. The current difference is converted to a voltage (e.g., based on the resistance of the first and second current detectors) and input to a switch controller as a feedback signal indicative of a voltage across the inductive element. When the current in the inductive element is not zero, the voltage is equal to the voltage across the LED. When the current is zero, the voltage will be oscillated due to the induction and capacitance of the inductive element, which can be used for valley mode detection to improve the efficiency of the LED driver. The switch controller controls switching of the switch based on the feedback signal to regulate output current through the one or more LEDs.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

As will be explained in more detail below with reference to the figures, a switching power supply providing a regulated output voltage with voltage feedback signal not requiring an auxiliary winding. For example, an LED lamp system and a method according to various embodiments generates a feedback signal indicating the regulated output voltage coupled to one or more LED devices without using an auxiliary transformer winding. As the auxiliary winding adds cost and complexity, generating a feedback signal independently of an auxiliary winding reduces a cost and complexity of the LED lamp system.

Figure 1:
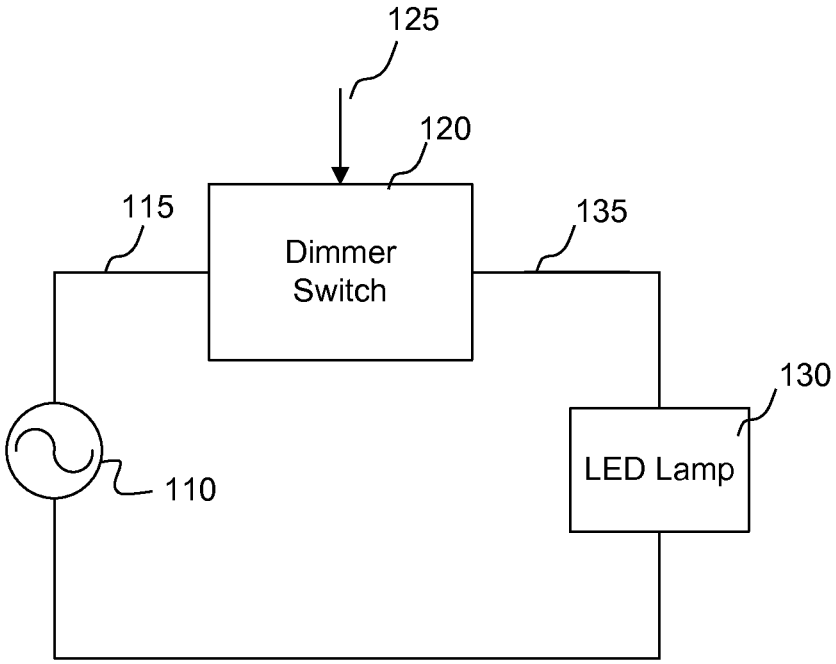
FIG. 1 illustrates an LED lamp circuit, according to one embodiment.

FIG. 1 illustrates an LED lamp system including an LED lamp 130 used with a conventional dimmer switch 120. The LED lamp 130 according to various embodiments is a direct replacement of an incandescent lamp in a conventional dimmer switch setting. A dimmer switch 120 is placed in series with AC input voltage source 110 and LED lamp 130. Dimmer switch 120 receives a dimming input signal 125 and uses the input signal 125 to set the desired light output intensity of LED lamp 130. Dimmer switch 120 receives AC input voltage signal 115 and adjusts the V-RMS value of lamp input voltage 135 in response to dimming input signal 125. In other words, control of the light intensity outputted by LED lamp 130 by dimmer switch 120 is achieved by adjusting the RMS value of the lamp input voltage 135 that is applied to LED lamp 130. The LED lamp 130 controls the light output intensity of LED lamp 130 to vary proportionally to the lamp input voltage 135, exhibiting behavior similar to incandescent lamps, even though LEDs are current-driven devices and not voltage driven devices. Dimming input signal 125 can either be provided manually (via a knob or slider switch, not shown herein) or via an automated lighting control system (not shown herein).

The dimmer switch 120 adjusts the V-RMS of lamp input voltage 135 by controlling the phase angle of the AC input voltage signal 115. In particular, the dimmer switch 120 reduces the V-RMS of input voltage 135 by eliminating a portion of each half-cycle of the AC input signal 115. Generally, the dimmer switch 120 increases the dimming effect (i.e., lowers the light intensity) by increasing the portion of each half-cycle that is eliminated and thereby decreasing the dimmer on-time.

Figure 2A:
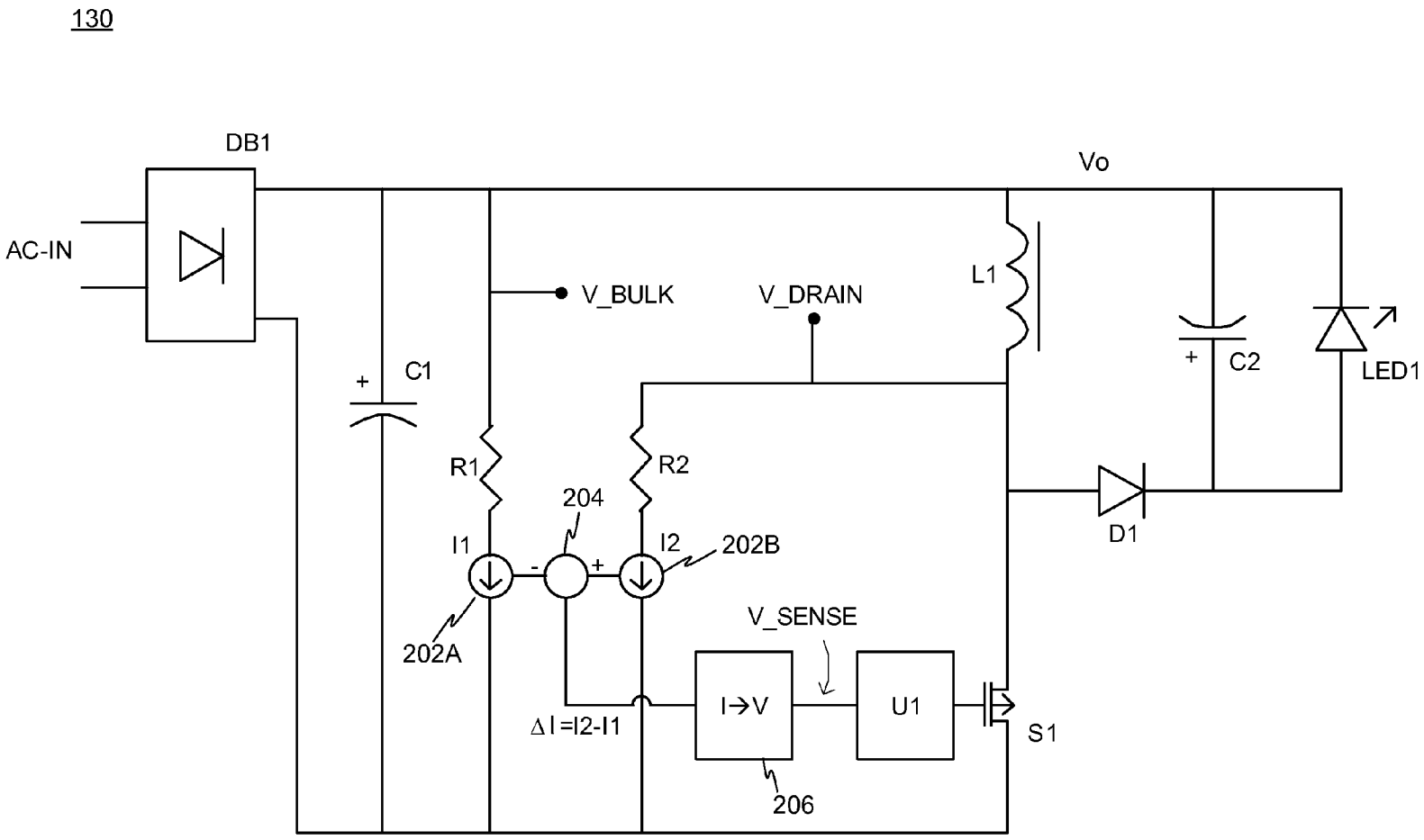
FIGS. 2A-2B are block diagrams illustrating components of an LED lamp, according to one embodiment.
Figure 2B:
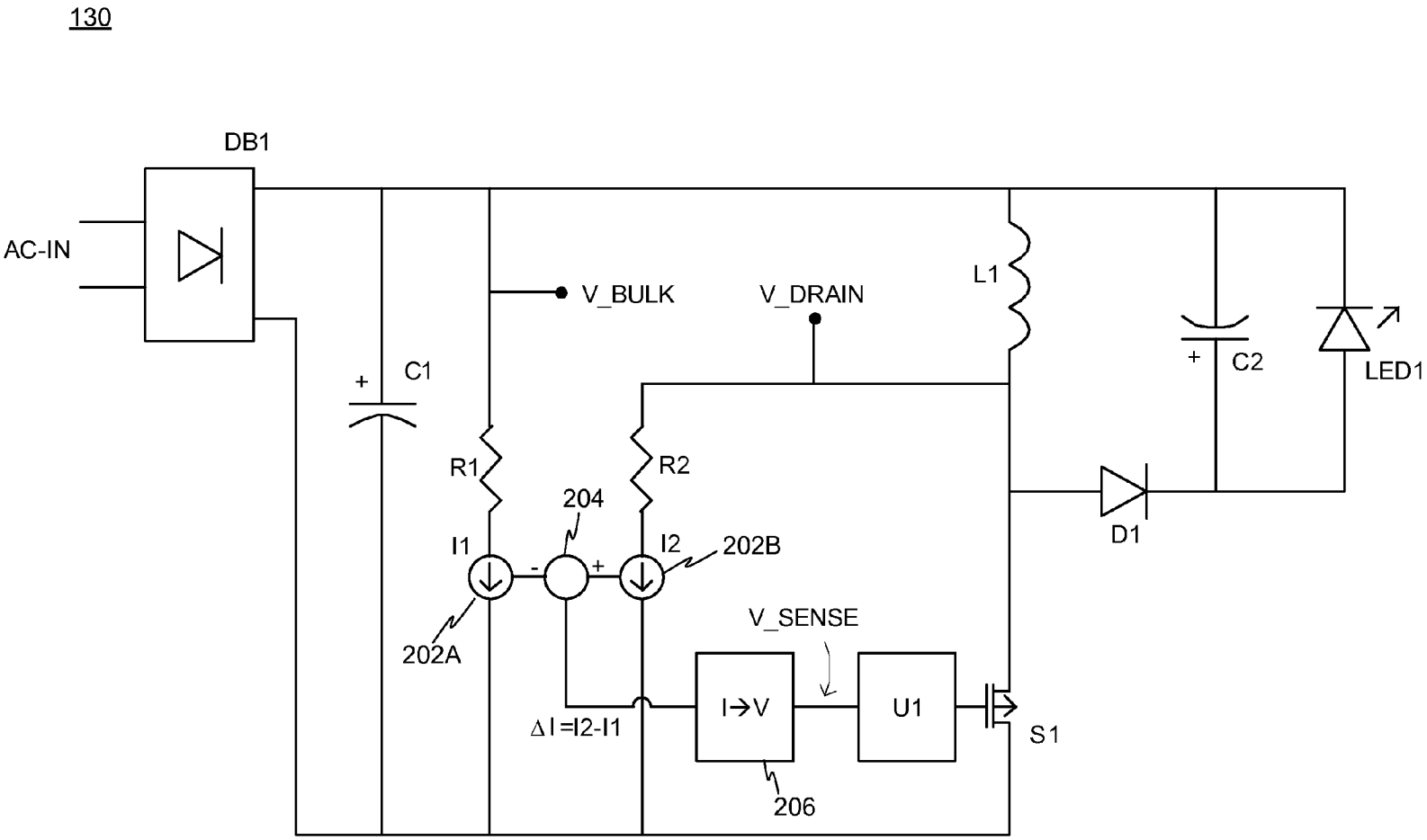

FIGS. 2A-B are block diagrams illustrating components of the LED lamp 130. In one embodiment, the LED lamp 130 comprises a bridge rectifier DB1, an input capacitor C1, an inductive element L1, an output capacitor C2, a switch S1, and a switch controller U1. Other embodiments of the LED lamp 130 may comprise different or additional components.

The bridge rectifier DB1 rectifies the voltage signal 135 input to the LED lamp 130 by the dimmer switch 120 and provides the rectified voltage across the input capacitor C1. Inductive element L1, diode D1, capacitor C2, and switch S1 form a buck boost type power converter providing a regulated current output to one or more LEDs, such as LED1 shown in FIG. 2. The controller U1 controls on and off cycles of the switch S1 to provide the regulated output current to LED1. When the switch S1 is turned on, power input to the LED lamp 130 is stored in the inductive element L1 because the diode D1 is reverse biased. During off cycles of the switch S2, current is provided to LED1 across the capacitor C2. In one embodiment, as shown in FIG. 2A, the inductive element L1 comprises a primary winding of a transformer. In another embodiment, as shown in FIG. 2B, the inductive element L1 is an inductor.

The controller U1 controls switching of switch S1 such that a substantially constant current is maintained through LED1. In one embodiment, the controller U1 receives a feedback voltage Vsense indicating an output voltage across L1 and controls switching of the switch S1 in response to the feedback. Furthermore, in one embodiment, the controller U1 receives a dimming signal from the dimmer switch 120 that is indicative of an amount of dimming for the LED lamp 130. In this case, the controller U1 controls current through LED1 such that an output light intensity from LED1 substantially corresponds to the amount of dimming for the LED lamp 130. The controller U1 can employ a number of modulation techniques, such as pulse-width modulation (PWM) or pulse-frequency modulation (PFM), to control the on and off states and duty cycles of the switch S1. PWM and PFM are techniques used for controlling switching power converters by controlling the widths and frequencies, respectively, of a drive signal generated by the controller U1 for driving the switch S1 to achieve output power regulation.

As shown in FIGS. 2A-B, LED1 is coupled across the inductive element L1 and is therefore a floating output (that is, not referenced to ground). Furthermore, because the rectified voltage input to the inductive element L1 is a high voltage input, it is difficult to directly measure the input voltage. To measure the output voltage across L1, the LED lamp 130 includes two current detectors R1 and R2, as shown in FIGS. 2A-B, which in one embodiment each comprise one or more resistors. The first current detector R1 is coupled between the input voltage source and a ground node of the LED lamp 130, while the second current detector R2 is coupled between the inductive element L1 and the ground node. A current I1 detected by the first current detector R1 is proportional to a bulk voltage V_bulk across the input capacitor C1 (that is, the voltage of the rectified signal input to the LED lamp 130 by the bridge rectifier DB1). A current I2 detected by the second current detector R2 is proportional to a drain voltage V_drain across the switch S1.

In one embodiment, the currents I1 and I2 are sensed (e.g., by ammeters 202A and 202B) and input to a comparator 204. The comparator 204 generates a signal ΔI representing a difference between the current I2 and the current I1. A current-to-voltage converter 206 receives the ΔI signal generated by the comparator 204 and determines the voltage across LED1 based on ΔI. For example, if the current detectors are each a resistor, the current-to-voltage converter 206 determines the voltage across the LED based on ΔI and the resistance of the resistors R1 and R2. The determined voltage across LED1 is output to the controller U1 as the voltage feedback signal Vsense. In another embodiment, the current-to-voltage converter 206 receives or detects the currents I1 and I2, converts the currents to equivalent voltages V_bulk and V_drain, and determines a difference between the equivalent voltages. In this case, the determined voltage difference is equivalent to the voltage Vo across the inductive element L1 and is output to the controller U1 as the feedback signal Vsense. In yet another embodiment, the controller U1 is configured to receive a signal representing the difference between currents I2 and I1, determine the voltage Vo across L1 based on the current difference, and control regulated output through LED1 in response to the determined voltage.

Figure 3:
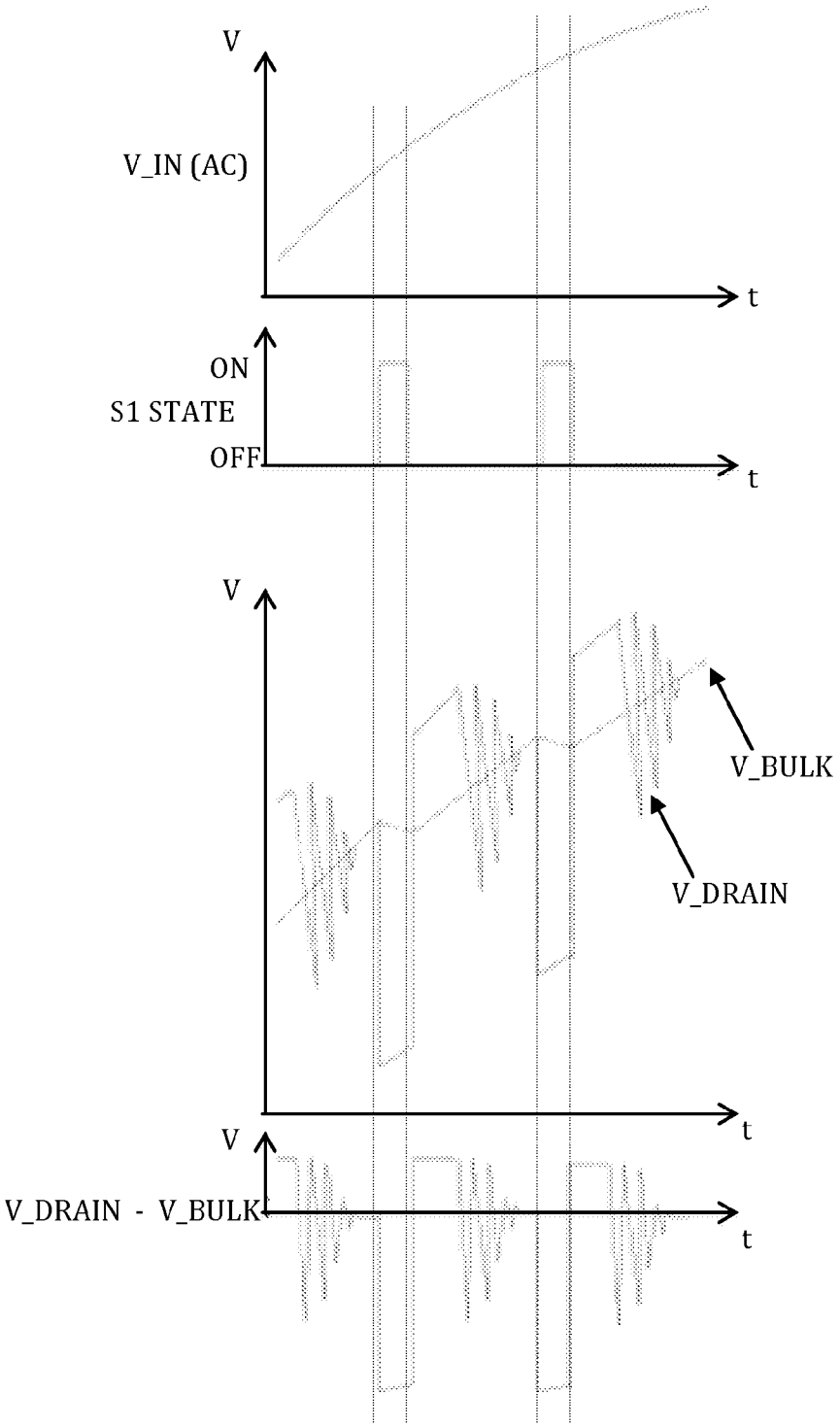
FIG. 3 illustrates example waveforms of a bulk voltage and a drain voltage, according to one embodiment.

FIG. 3 illustrates example waveforms of a bulk voltage V_bulk and a drain voltage V_drain measured by the current-to-voltage converter 206. Illustrated in FIG. 3 is a portion of a cycle of the AC input signal V_in as well as switching of the switch S1 during the cycle, measured values of V_bulk and V_drain, and a ΔV signal generated by subtracting V_bulk from V_drain. As shown in FIG. 3, V_bulk measured by the current-to-voltage converter 206 is affected by the magnitude of the AC input voltage, increasing during off cycles of the switch S1 in proportion to increases in the magnitude of the AC input voltage. V_drain is similarly affected by the magnitude of the AC input voltage, and also exhibits high frequency voltage oscillations during off cycles of the switch S1 resulting from resonance of the inductive element L1 and the output capacitor C2. By subtracting V_bulk from V_drain, the current-to-voltage converter 206 removes the low-frequency voltage changes in V_drain resulting from the AC input voltage and generates the signal ΔV.

Figure 4:
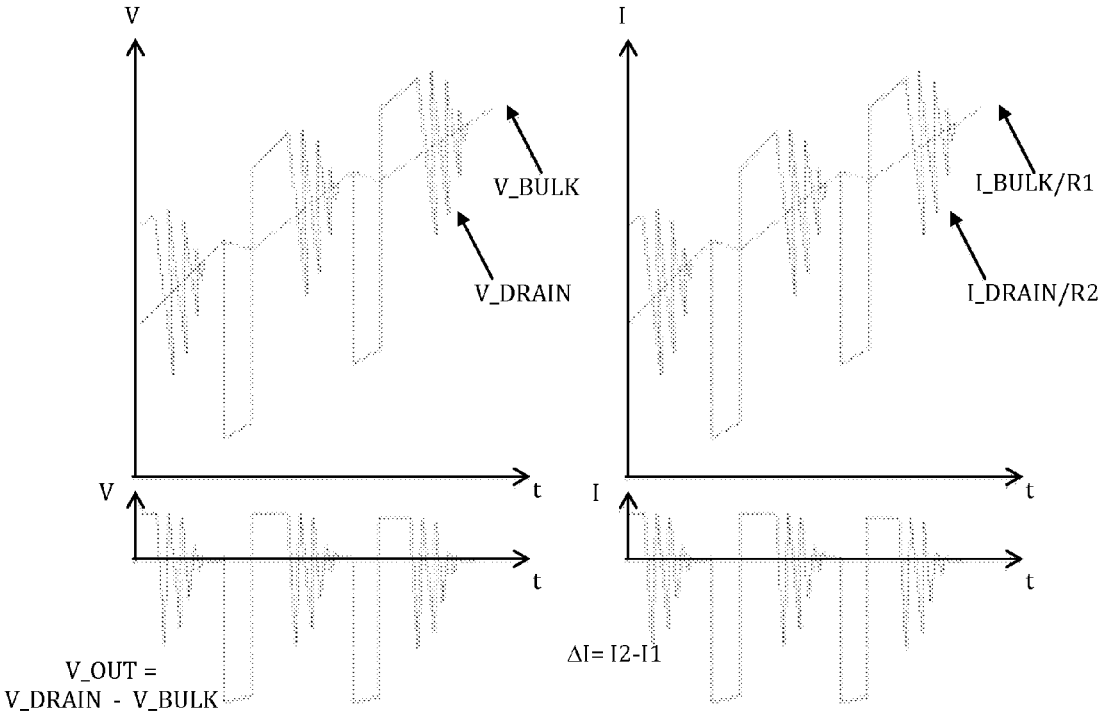
FIG. 4 illustrates example waveforms demonstrating relationships between bulk voltage, bulk current, drain voltage, and drain current, according to one embodiment.

FIG. 4 illustrates example waveforms demonstrating a relationship between the bulk voltage V_bulk and the current detected by the first current detector R1, as well as a relationship between the drain voltage V_drain and the current detected by the second current detector R2. As shown in FIG. 4, the current I1 detected by the first current detector R1 is proportional to V_bulk and the current I2 detected by the second current detector R2 is proportional to V_drain. Accordingly, a signal ΔI generated by subtracting the current detected by the first current detector from the current detected by the second current detector is proportional to the signal ΔV representing the difference between the drain and bulk voltages. Thus, by measuring the current difference ΔI, the current-to-voltage converter indirectly measures the voltage across LED1.

A large difference in magnitude of the voltage of the two nodes, as there is in the case of the above example using V_bulk and V_drain to provide the voltage feedback signal, will tend to increase the inaccuracy of the resulting voltage feedback signal. For example, in the case of a buck-boost converter in which the turns ratio of the inductive element L1 is 1:

$$I1=V_bulk/R1 \text{ and } I2=V_drain/R2, \text{ or } V\text{drain}=V\text{bulk}+Vo.$$

Therefore:

$$I2=(V\text{bulk}+Vo)/R2$$

and $$\Delta I=I2-I1=(V\text{bulk}+Vo)/R2-V\text{bulk}/R1.$$

If R1=R2, it simplifies to Vo/R1, but when R2 is not equal to R1, then ΔI is $$\Delta I=V\text{bulk}/R2-V\text{bulk}/R1+Vo/R2.$$

With the first two terms not cancelling and considering that V_bulk is >>Vo, which it is in the above example, it corrupts the measurement of the output voltage (Vo) in a manner that is worsens as Vbulk increases. This problem can be solved by multiplying one of the terms by a normalizing factor (k), where $$\Delta I=I2*k-I1 \text{ or } \Delta I=I2-k*I1.$$

The variable k can be easily calibrated by the controller U1 when in the dead zone after the reset period of the switch, when V_drain=V_bulk. The normalizing factor "k" can be adjusted to calibrate the offset that is introduced by the common mode voltage. In one embodiment, the normalizing factor "k" is calibrated so that the difference output (voltage feedback) results in 0V.

The LED lamps according to various embodiments of the present disclosure have the advantage that the LED lamp can be a direct replacement of conventional incandescent lamps in typical wiring configurations found in residential and commercial lighting applications, and that the LED lamp can be used with conventional dimmer switches that carry out dimming by changing the input voltage to the lamps. Moreover, a feedback signal indicating voltage across the LED is generated without relying on an auxiliary winding, thereby reducing the cost and complexity of the LED lamp.

Upon reading this disclosure, those of skill in the art will appreciate still additional alternative designs for an LED lamp. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention.

What is claimed is:

1. A light-emitting diode (LED) lamp, comprising:
- one or more LEDs;
- an inductor coupled to an input voltage source and the one or more LEDs;
- a switch coupled to the inductor, current in the inductor being generated responsive to the switch being turned on and not generated responsive to the switch being turned off;
- a first current detector coupled between the input voltage source and a ground node of the LED lamp, the first current detector detecting a current that is proportional to a bulk voltage across the input voltage source;
- a second current detector coupled between the inductor and the ground node, the second current detector detecting a current that is proportional to a drain voltage across the switch;
- a current-to-voltage converter configured to:
  - convert a difference between the current detected by the first current detector and the current detected by the second current detector to a voltage signal based on a resistance of the first current detector and a resistance of the second current detector, and
  - generate a feedback signal proportional to a regulated output voltage from the LED lamp based on the voltage signal; and
- a switch controller receiving the feedback signal and controlling switching of the switch based on the feedback signal to regulate an output current through the one or more LEDs.

2. The LED lamp of claim 1, further comprising:
- a comparator receiving the current detected by the first current detector and the current detected by the second current detector, the comparator adapted to generate the difference between the current detected by the second current detector and the current detected by the first current detector.

3. The LED lamp of claim 1, wherein the current-to-voltage converter converts the difference to the voltage signal by:
- receiving the current detected by the first current detector and the current detected by the second current detector;
- converting the current detected by the first current detector to a bulk voltage based on the resistance of the first current detector and converting the current detected by the second current detector to a drain voltage based on the resistance of the second current detector; and
- determining the regulated output voltage by subtracting the drain voltage from the bulk voltage.

4. The LED lamp of claim 1, wherein the switch controller receives an input signal from a dimmer switch indicative of an amount of dimming for the LED lamp, and wherein the switch controller is adapted to regulate the output current through the one or more LEDs based on the input signal such that an output light intensity of the one or more LEDs substantially corresponds to the amount of dimming for the LED lamp.

5. The LED lamp of claim 1, wherein the one or more LEDs are coupled across the inductor.

6. The LED lamp of claim 1, wherein the switch is coupled between the inductor and the ground node of the LED lamp.

7. The LED lamp of claim 1, wherein the feedback signal is further generated based on a calibration factor applied to one of the current detected by the first current detector and the current detected by the second current detector.

8. A light-emitting diode (LED) lamp, comprising:

one or more LEDs;

a transformer comprising a primary winding, the primary winding coupled to an input voltage source and the one or more LEDs;

a switch coupled to the primary winding, current in the primary winding being generated responsive to the switch being turned on and not generated responsive to the switch being turned off;

a first current detector coupled between the input voltage source and a ground node of the LED lamp, the first current detector detecting a current that is proportional to a bulk voltage across the input voltage source;

a second current detector coupled between the primary winding and the ground node, the second current detector detecting a current that is proportional to a drain voltage across the switch;

a current-to-voltage converter configured to:

convert a difference between the current detected by the first current detector and the current detected by the second current detector to a voltage signal based on a resistance of the first current detector and a resistance of the second current detector, and generate a feedback signal proportional to a regulated output voltage from the LED lamp based on the voltage signal; and a switch controller receiving the feedback signal and controlling switching of the switch based on the feedback signal to regulate an output current through the one or more LEDs.

9. The LED lamp of claim 8, further comprising:

a comparator receiving the current detected by the first current detector and the current detected by the second current detector, the comparator adapted to generate the difference between the current detected by the second current detector and the current detected by the first current detector.

10. The LED lamp of claim 8, wherein the current-to-voltage converter converts the difference to the voltage signal by:

receiving the current detected by the first current detector and the current detected by the second current detector;

converting the current detected by the first current detector to a bulk voltage based on the resistance of the first current detector and converting the current detected by the second current detector to a drain voltage based on the resistance of the second current detector; and determining the regulated output voltage by subtracting the drain voltage from the bulk voltage.

11. The LED lamp of claim 8, wherein the switch controller receives an input signal from a dimmer switch indicative of an amount of dimming for the LED lamp, and wherein the switch controller is adapted to regulate the output current through the one or more LEDs based on the input signal such that an output light intensity of the one or more LEDs substantially corresponds to the amount of dimming for the LED lamp.

12. The LED lamp of claim 8, wherein the one or more LEDs are coupled across the primary winding of the transformer.

13. The LED lamp of claim 8, wherein the switch is coupled between the primary winding of the transformer and the ground node of the LED lamp.

14. The LED lamp of claim 8, wherein the feedback signal is further generated based on a calibration factor applied to one of the current detected by the first current detector and the current detected by the second current detector.

15. A method for driving an LED lamp comprising one or more LEDs, an inductor coupled to an input voltage source and the one or more LEDs, a switch coupled to the inductor, a first current detector coupled between the input voltage source and a ground node of the LED lamp, and a second current detector coupled between the inductor and the ground node, wherein current in the inductor is generated responsive to the switch being turned on and not being generated responsive to the switch being turned off, current detected by the first current detector is proportional to a bulk voltage across the input voltage source, and current detected by the second current detector is proportional to a drain voltage across the switch, the method comprising:

receiving the current detected by the first current detector and the current detected by the second current detector;

converting a difference between the current detected by the first current detector and the current detected by the second current detector to a voltage signal based on a resistance of the first current detector and a resistance of the second current detector;

generating a feedback signal proportional to a regulated output voltage from the LED lamp based on the voltage signal; and controlling switching of the switch based on the feedback signal to regulate an output current through the one or more LEDs.

16. The method of claim 15, further comprising:

determining by a comparator, the difference between the current detected by the second current detector and the current detected by the first current detector.

17. The method of claim 15, wherein generating the feedback signal comprises:

converting the current detected by the first current detector to a bulk voltage based on the resistance of the first current detector and converting the current detected by the second current detector to a drain voltage based on the resistance of the second current detector; and determining the regulated output voltage by subtracting the drain voltage from the bulk voltage.

18. The method of claim 15, further comprising:

receiving an input signal from a dimmer switch indicative of an amount of dimming for the LED lamp; and regulate output current through the one or more LEDs based on the input signal such that an output light intensity of the one or more LEDs substantially corresponds to the amount of dimming for the LED lamp.

19. The method of claim 15, wherein the feedback signal is further generated based on a calibration factor applied to one of the current detected by the first current detector and the current detected by the second current detector.

* * * * *